US007977614B2

(12) United States Patent
Raviv

(10) Patent No.: US 7,977,614 B2
(45) Date of Patent: Jul. 12, 2011

(54) METHOD AND SYSTEM FOR DEFENSE AGAINST INCOMING ROCKETS AND MISSILES

(75) Inventor: Dov Raviv, Rishon Lezion (IL)

(73) Assignee: E.C.S. Engineering Consulting Services-Aerospace Ltd., Rishon Lezion (IL)

( * ) Notice: Subject to any disclaimer, the term of this patent is extended or adjusted under 35 U.S.C. 154(b) by 237 days.

(21) Appl. No.: 12/438,826

(22) PCT Filed: Sep. 3, 2007

(86) PCT No.: PCT/IL2007/001084

§ 371 (c)(1),
(2), (4) Date: Mar. 26, 2009

(87) PCT Pub. No.: WO2008/029392

PCT Pub. Date: Mar. 13, 2008

(65) Prior Publication Data

US 2009/0314878 A1 Dec. 24, 2009

(30) Foreign Application Priority Data

| | | |
|---|---|---|
| Sep. 3, 2006 | (IL) | 177852 |
| Oct. 4, 2006 | (IL) | 178443 |
| Oct. 15, 2006 | (IL) | 178612 |

(51) Int. Cl.

| | |
|---|---|
| ***F41G 7/30*** | (2006.01) |
| ***F41G 7/20*** | (2006.01) |
| ***F42B 15/01*** | (2006.01) |
| *F41G 7/00* | (2006.01) |
| *F42B 15/00* | (2006.01) |

(52) U.S. Cl. ..... 244/3.11; 244/3.1; 244/3.14; 244/3.15; 244/3.16; 244/3.19; 342/61; 342/62; 89/1.11

(58) Field of Classification Search ..... 89/1.11, 89/1.1, 1.8, 1.819; 244/3.1, 3.15–3.3, 3.11–3.14; 102/501–509, 473, 491–497; 342/13, 61–62
See application file for complete search history.

(56) References Cited

U.S. PATENT DOCUMENTS

| | | | | |
|---|---|---|---|---|
| 3,728,964 | A * | 4/1973 | Abernathy | 244/3.28 |
| 3,974,771 | A | 8/1976 | Thomanek | |
| 3,982,713 | A * | 9/1976 | Martin | 244/3.1 |
| 4,072,107 | A * | 2/1978 | Saxe et al. | 244/3.27 |
| 4,553,718 | A * | 11/1985 | Pinson | 244/3.15 |
| 4,614,317 | A * | 9/1986 | Stavis | 244/3.19 |
| 4,768,440 | A | 9/1988 | Deneuville et al. | |
| 4,848,239 | A | 7/1989 | Wilhelm | |

(Continued)

FOREIGN PATENT DOCUMENTS

DE 4128313 3/1993

*Primary Examiner* — Bernarr E Gregory
(74) *Attorney, Agent, or Firm* — Weingarten, Schurgin, Gagnebin & Lebovici LLP

(57) ABSTRACT

An interception system for intercepting incoming missiles and/or rockets including a launch facility, a missile configured to be launched by the launch facility, the missile having a fragmentation warhead, a ground-based missile guidance system for guiding the missile during at least one early stage of missile flight and a missile-based guidance system for guiding the missile during at least one later stage of missile flight, the missile-based guidance system being operative to direct the missile in a last stage of missile flight in a head-on direction vis-a-vis an incoming missile or rocket.

13 Claims, 1 Drawing Sheet

U.S. PATENT DOCUMENTS

| | | | | | |
|---|---|---|---|---|---|
| 4,925,129 | A | | 5/1990 | Salkeld et al. | |
| 4,970,960 | A | * | 11/1990 | Feldmann | 102/506 |
| 5,050,818 | A | | 9/1991 | Sundermeyer | |
| 5,261,629 | A | * | 11/1993 | Becker et al. | 244/3.22 |
| 5,458,041 | A | * | 10/1995 | Sun et al. | 89/1.11 |
| 5,464,174 | A | | 11/1995 | Laures | |
| 5,611,502 | A | * | 3/1997 | Edlin et al. | 244/3.16 |
| 5,661,254 | A | | 8/1997 | Steuer et al. | |
| 5,662,291 | A | * | 9/1997 | Sepp et al. | 244/3.13 |
| 5,696,347 | A | * | 12/1997 | Sebeny et al. | 244/3.15 |
| 5,710,423 | A | * | 1/1998 | Biven et al. | 244/3.1 |
| 5,780,766 | A | * | 7/1998 | Schroppel | 244/3.27 |
| 5,862,496 | A | * | 1/1999 | Biven | 244/3.11 |
| 6,209,820 | B1 | * | 4/2001 | Golan et al. | 244/3.15 |
| 6,279,482 | B1 | | 8/2001 | Smith et al. | |
| 6,626,396 | B2 | * | 9/2003 | Secker | 244/3.16 |
| 6,771,205 | B1 | * | 8/2004 | Barton et al. | 342/13 |
| 6,920,827 | B2 | * | 7/2005 | Llyod | 102/497 |
| 6,931,166 | B2 | | 8/2005 | Gauthier, Jr. et al. | |
| 6,990,885 | B2 | | 1/2006 | Boyd | |
| 7,017,467 | B1 | | 3/2006 | Monroe | |
| 7,026,980 | B1 | | 4/2006 | Mavroudakis et al. | |
| 7,028,947 | B2 | | 4/2006 | Burns | |
| 7,092,862 | B2 | | 8/2006 | Hooks | |
| 7,137,588 | B2 | * | 11/2006 | Humphrey | 244/3.15 |
| 7,190,304 | B1 | * | 3/2007 | Carlson | 342/62 |
| 7,348,918 | B2 | * | 3/2008 | Redano | 342/62 |
| 7,494,089 | B2 | * | 2/2009 | Williams et al. | 244/3.16 |
| 7,513,455 | B1 | * | 4/2009 | Mavroudakis et al. | 244/3.15 |
| 7,540,227 | B2 | * | 6/2009 | McCants, Jr. | 89/1.819 |

* cited by examiner

METHOD AND SYSTEM FOR DEFENSE AGAINST INCOMING ROCKETS AND MISSILES

REFERENCE TO RELATED APPLICATIONS

Reference is hereby made to Israel Patent Application Number 177582, filed Sep. 3, 2006 and entitled "METHOD AND SYSTEM FOR DEFENSE AGAINST INCOMING ROCKETS AND MISSILES", Israel Patent Application Number 178443, filed Oct. 4, 2006 and entitled "METHOD AND SYSTEM FOR DEFENSE AGAINST INCOMING ROCKETS AND MISSILES" and Israel Patent Application Number 178612, filed Oct. 15, 2006 and entitled "METHOD AND SYSTEM FOR DEFENSE AGAINST INCOMING ROCKETS AND MISSILES," the disclosures of which are hereby incorporated by reference and priority of which is hereby claimed pursuant to 37 C.F.R. 1.55.

FIELD OF THE INVENTION

The present invention relates to systems and methods for intercepting and destroying incoming rockets and missiles.

BACKGROUND OF THE INVENTION

The following U.S. patents are believed to represent the current state of the art: U.S. Pat. Nos. 7,092,862; 7,028,947; 7,026,980; 7,017,467; 6,990,885 and 6,931,166.

SUMMARY OF THE INVENTION

The present invention seeks to provide improved and highly cost-effective systems and methods for intercepting and destroying incoming rockets and missiles.

There is thus provided in accordance with a preferred embodiment of the present invention, an interception system for intercepting incoming missiles and/or rockets including a launch facility, a missile configured to be launched by the launch facility, the missile having a fragmentation warhead, a ground-based missile guidance system for guiding the missile during at least one early stage of missile flight and a missile-based guidance system for guiding the missile during at least one later stage of missile flight, the missile-based guidance system being operative to direct the missile in a last stage of missile flight in a head-on direction vis-à-vis an incoming missile or rocket.

Preferably, the missile-based guidance system includes a strap-on, non-gimbaled short range radar sensor and a strap-on, non-gimbaled optical sensor. Additionally, the short range radar sensor senses the relative positions and speeds of the missile and the incoming missile or rocket. Preferably, the short range radar sensor provides a detonation trigger output to the fragmentation warhead based on the relative positions and relative speeds of the missile and the incoming missile or rocket. Additionally, the short range radar sensor also provides a guidance output for governing the direction of the missile during the at least one later stage of missile flight.

Preferably, the short range radar sensor provides sensing back up for the optical sensor, when the optical sensor is not fully functional. Additionally or alternatively, the interception system also includes an early warning system operative to provide information relating to the incoming missile or rocket to the launch facility.

There is also provided in accordance with another preferred embodiment of the present invention a method for intercepting incoming missiles and/or rockets including launching at least one missile, the at least one missile having a fragmentation warhead, guiding the at least one missile, using a ground-based missile guidance system, during at least one early stage of missile flight, guiding the at least one missile, using a missile-based guidance system, during at least one later stage of missile flight and directing the missile, using the missile-based guidance system, in a last stage of missile flight in a head-on direction vis-à-vis an incoming missile or rocket.

Preferably, the method also includes sensing the relative positions and relative speeds of the missile and the incoming missile or rocket. Additionally, the method also includes providing a detonation trigger output to the fragmentation warhead based on the sensing the relative positions and relative speeds.

Additionally or alternatively, the method also includes providing information relating to the incoming missile or rocket to the at least one missile.

BRIEF DESCRIPTION OF THE DRAWINGS

The present invention will be better understood and appreciated from the following detailed description, taken in conjunction with the drawing in which.

DETAILED DESCRIPTION OF PREFERRED EMBODIMENTS

Figure 1:
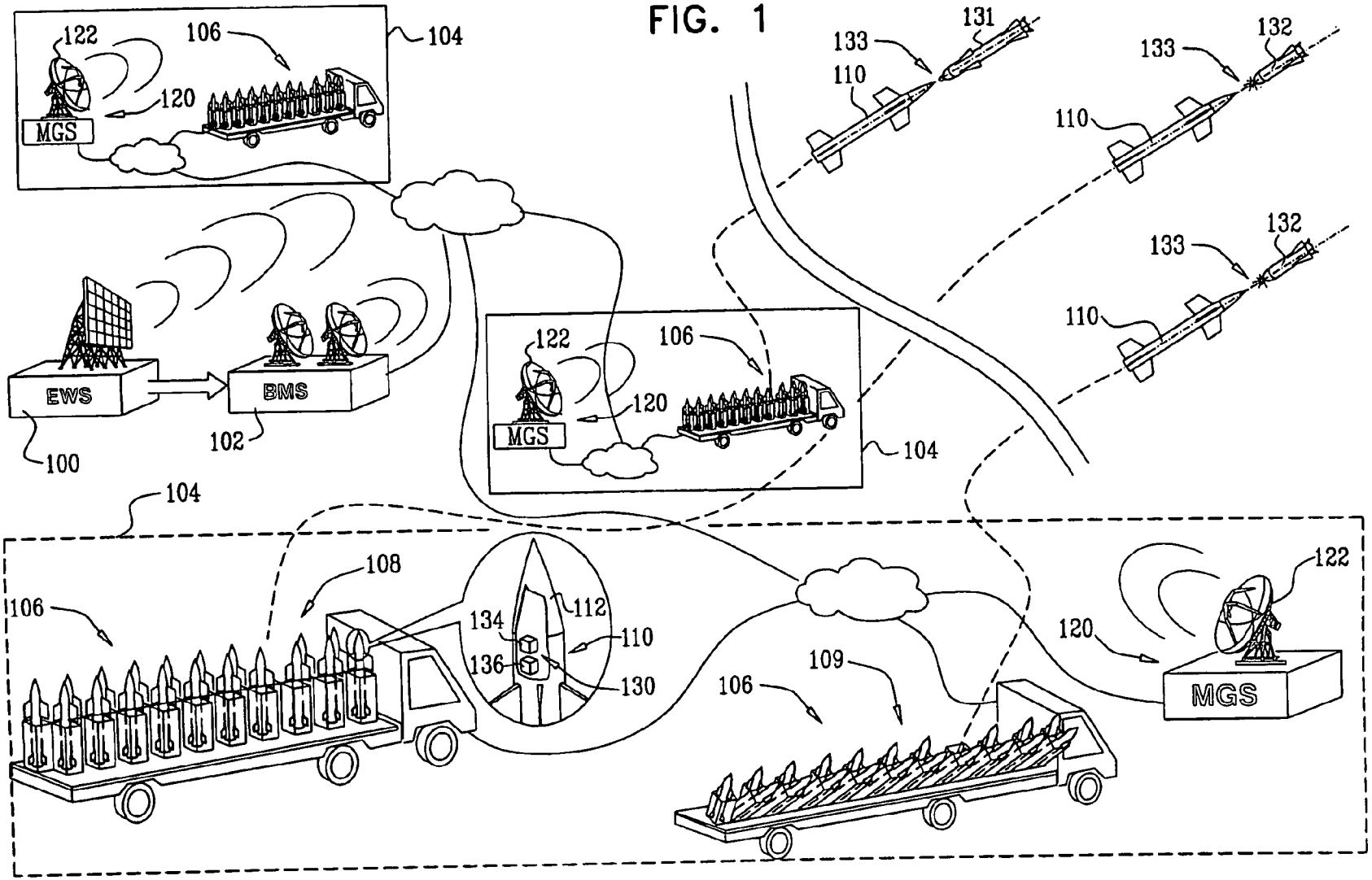
FIG. 1 is a simplified, partially pictorial, partially schematic illustration of an interception system for intercepting incoming missiles and/or rockets constructed and operative in accordance with a preferred embodiment of the present invention.

Reference is now made to FIG. 1, which is a simplified, partially pictorial, partially schematic illustration of an interception system for intercepting incoming missiles and/or rockets constructed and operative in accordance with a preferred embodiment of the present invention.

As seen in FIG. 1, the interception system for intercepting incoming missiles and/or rockets, constructed and operative in accordance with a preferred embodiment of the present invention, preferably includes an Early Warning System (EWS) 100 which confirms that a rocket or missile was fired, tracks the rocket or missile and confirms that its impact location is in an area to be protected. If so, a Battle Management System (BMS) 102 chooses a battery 104 to intercept the rocket or missile and provides the relevant data of the incoming rocket or missile, e.g. its coordinates, velocity and predicted trajectory. The Battle Management System preferably includes multiple phased array radars capable of detecting a 0.1 msq target at 50 km with range accuracy of 5 m and azimuth and elevation accuracy of 0.3 mrad. Accordingly, for a range of 30 km, the required accuracies are:

5 m in range 9 m in azimuth 9 m in elevation

Differential accuracies should be about ⅓ due to elimination of biases.

Each battery 104 includes one or more launch facilities, generally indicated by reference numeral 106, two alternative configurations of which are illustrated and respectively designated by reference numerals 108 and 109. Each launch facility preferably includes a plurality of interceptor missiles 110, typically 20, each having a fragmentation warhead 112.

Each interceptor missile 110 is preferably capable of maneuvering at a rate of 60 deg/sec when reaching a velocity of 100 m/s at approximately 0.7 sec after launch. Launch facility 108 preferably comprises 20 fixed vertical launch canisters, each of cross section 40 cm, arranged for vertical launching. Launch facility 109 preferably comprises 20 fixed attitude launch canisters, each of cross section 40 cm, arranged for launching at an initial attitude of 15 degrees or 45 degrees. Adjacent canisters are at different angles to the horizontal in order to avoid interference between wings of adjacent interceptor missiles 110.

The high maneuverability of interceptor missiles 110 enables any trajectory angle to be reached within 1.5 seconds with minimal velocity loss.

A ground-based missile guidance system 120 associated with each battery 104, including a ground-based radar 122, provides guidance instructions to each interceptor missile 110 during at least one early stage of missile flight.

Each interceptor missile 110 preferably includes a missile-based guidance system 130 for guiding the interceptor missile 110 during at least one later stage of missile flight. It is a particular feature of the present invention that the missile-based guidance system 130 is operative to direct the interceptor missile 110 in a final stage of missile flight in a head-on direction vis-à-vis an incoming missile 131 or rocket 132. This final stage of missile flight is shown schematically in FIG. 1 and designated by reference numeral 133.

Preferably, the missile-based guidance system 130 comprises a strap-on, non-gimbaled short range radar sensor 134 and a strap-on, non-gimbaled optical sensor 136. The short range radar sensor 134 preferably senses the relative positions and speeds of interceptor missile 110 and incoming missile 131 or rocket 132. Additionally, the short range radar sensor 134 also provides a guidance output for governing the direction of interceptor missile 110 during the final stage of missile flight 133. Further, the short range radar sensor 134 provides sensing back up for the optical sensor 136, when the optical sensor 136 is not fully functional, such as due to weather or other environmental conditions.

Preferably, the short range radar sensor 134 provides a detonation trigger output to the fragmentation warhead 112 based on the relative positions and relative speeds of the interceptor missile 110 and the incoming missile 131 or rocket 132.

It is a particular feature of the system and methodology of the present invention that it is cost effective. Cost effectiveness is a strategic feature of the present invention, which enables it to be useful against large numbers of incoming missiles 131 and rockets 132.

The short range radar sensor 134 is an all-weather sensor operative at 100 Hz and having high accuracy up to 1000 m. For an expected end game of 1 sec, sensor 134 is suitable for closing velocities of about 1000 m/sec.

In order to overcome limitations in the radar sensor 134, optical sensor 136 provides enhanced accuracy at longer ranges which enables engagement with faster targets that are fired from longer ranges. Optical sensor 136 is preferably an Infra Red (IR) bolometric sensor that is sensitive to temperature which operates above the weather and enables a hot rocket or missile target to be detected and tracked at long range with high accuracy.

It is appreciated that the end game is performed head-on, such that the interceptor missile 110 sees the target within the FOV of the sensor 134. When the interceptor missile 110 maneuvers, the target is seen at an angular position identical to the angle of attack. Due to the limitation of angle of attack to 6 degrees, the field of view of the sensors can be limited to 12 degrees. This eliminates the need for gimballing of the sensors. Another factor relates to the integration time of the sensor and the "smearing" of the signal due to the angular velocity of the interceptor missile 110 during the end game. This consideration requires stabilization of the sensors' line of sight to ±6 degrees to keep the target within one pixel (or radar beam) during acquisition, when S/N is low. When the S/N increases beyond 20, the smear is not of significance.

Preferred parameters of radar sensor 134 are as follows:

| | |
|---|---|
| Beam size | 9-12 degrees |
| Angular measurement accuracy | 1.5 mrad at 1000 m |
| Angular measurement accuracy | 0.5 mrad at 500 m |
| Range accuracy | 0.5 m |
| Doppler accuracy | 0.5 m/sec |
| Measurement rate | 100 per second |

Preferred parameters of optical sensor 136 are as follows:

| | |
|---|---|
| Two Field of View angles | 6 degrees and 12 degrees |
| Sensor dimension | 388 × 280 pixels |
| Measurement resolution | 0.54 mrad for 12 deg FOV |
| Measurement resolution | 0.27 mrad for 6 deg FOV |
| NETD at 3 sigma | 1 deg C. |
| Measurement rate | 60 per second |
| S/N as function range, target size and target temperature | see hereinbelow |

The radar sensor 134 is necessary for the fusing of the warhead 112. When target acquisition is achieved using solely the optical sensor 136, the radar sensor 134 may be employed only as a range finder.

Inasmuch as the radar sensor 134 is broad band, typically only one such sensor can operate at a time. Time division multiplexing may be employed in order to allow operation of a number of seekers. For example, allocating 5 msec out of 50 msec (20 Hz) to each radar sensor 134 enables ten interceptor missiles 110 to operate simultaneously. This number can be increased by a factor of two or three by using two or three different frequencies. Alternatively, interceptions may be micromanaged such that end games will occur at such intervals that the radar sensor 134 are not be operated in parallel.

This issue is most acute for incoming rocket salvos. In the case of long range incoming missiles 131 the problem is less acute because there are few if any salvos and the radar sensor 134 is often used only for fusing which takes less than one second.

In order for the invention to be fully understood, a brief summary of the threat which the system and methodology of the present invention addresses is presented hereinbelow:

Salvo attacks of incoming missiles 131 and rockets 132 having the following parameters can be expected:

From a range of up to 40 km, 50 rockets 132 at intervals of 1 sec;

From a range of between 40 km and 100 km, 20 rockets 132 at intervals of 1 sec;

From a range greater than 100 km, 5 rockets 132 or missiles 131 at intervals of 5 sec.

The following trajectories are synthetic and are calculated within the atmosphere assuming Flat Earth. These synthetic trajectories underestimate the reentry velocity and the reentry temperature of real threats. The threats are divided into three categories:

I: Rockets 132 having initial velocities of 300 and 1000 m/sec at low and high firing angles II: Rockets 132 having an initial velocity of 1500 m/sec at low and high firing angles III: Guided missiles 131 at ranges of 580 km and 1800 km fired at an initial altitude of 30 km at an angle of 42 degrees and having initial velocities of 2000 and 3500 m/sec respectively, The following Tables I-III depict operational parameters for these three categories:

TABLE I

CATEGORY I

| Drag Coefficient = 0.5 Rockets Velocity m/sec | D = 120, 220 mm Firing angle deg | Mass = 50, 100 kg Range km | Apogee Km | Gamma impact deg | T-flight sec | V-reentry m/s | Temp at reentry deg C. |
|---|---|---|---|---|---|---|---|
| 300 | 30 | 6.8 | 1087.7 | −39.2 | 30.7 | 207.5 | 50.1 |
| 300 | 60 | 10.2 | 4421.9 | −78.4 | 71.5 | 162.3 | 21.4 |
| 1000 | 30 | 19.0 | 4534.1 | −71.8 | 65.5 | 200.1 | 50.2 |
| 1000 | 60 | 26.6 | 11470.9 | −89.4 | 65.5 | 144.3 | 10.0 |

TABLE II

CATEGORY II

| Drag Coefficient = 0.5 Rockets Velocity m/sec | D = 300 mm Firing angle deg | Mass = 300 kg Range km | Apogee km | Gamma impact deg | T-flight sec | V-reentry m/s | Temp at reentry deg C. |
|---|---|---|---|---|---|---|---|
| 1500 | 20 | 32 | 4.7 | −50.7 | 62.8 | 458.4 | 90.1 |
| 1500 | 30 | 41 | 9.4 | −68.4 | 93.3 | 402.9 | 100.2 |
| 1500 | 60 | 107 | 42.4 | −75.3 | 218.4 | 519.6 | 100.2 |
| 1500 | 70 | 140 | 68.1 | −78.0 | 288.7 | 582.4 | 120.0 |

TABLE III

CATEGORY III

| Drag Coefficient = 0.35 Missiles Velocity m/sec | D = 1000 mm Firing angle deg | Mass = 1000 kg Range km | Apogee km | Gamma impact deg | T-flight sec | V-reentry m/s | Temp at reentry deg C. |
|---|---|---|---|---|---|---|---|
| 2000 | 42.0 | 588 | 137.8 | −64.5 | 355.6 | 939.7 | 770.1 |
| 3500 | 42.0 | 1682 | 358.7 | −53.2 | 572.5 | 1609.7 | 2453.3 |

Characteristics of the fragmentation warhead 112 are described hereinbelow:

Assuming a head-on interception, as illustrated in FIG. 1 at reference numeral 133, and assuming the smallest target to be a rocket 132 having a diameter of 120 mm.

Detonation of this target requires impact therewith of at least one 70 gram fragment at a velocity of 2000 m/s.

The preferred fragmentation warhead 112 is of the forward ejecting type preferably containing 64 fragments of 70 grams each preferably tungsten or depleted uranium, for a total weight of 4,500 gram. To achieve an impact velocity of 2000 m/sec, and knowing that the closing velocity is more than 800 m/sec, the static fragment velocity required is 1200 m/sec. To accelerate the fragments to 1200 m/sec, a high explosive mass of 4.5 kg is required. Preferably, the diameter of fragmentation warhead 112 is 150 mm and the fragments are arranged in a single layer. Typically the fragmentation warhead 112 is fixed with respect to interceptor missile 110.

Alternatively, a directable fragmentation warhead may be employed to increase the possible miss distance. In such a case if the miss distance is 1 m, the warhead must be oriented to close the miss distance by 70 cm to the original requirement of 30 cm for a non-aimable warhead. For example, from a distance of 3.5 m, the warhead should be aimed at an angle of ATAN(0.7/3.5)=11.2 deg.

A typical operational situation is described below:

At a range of 300 m the interceptor missile 110 is positioned in a staring mode at Jy=0 (Zero lateral acceleration) to measure the direction to the target, which is actually the miss angle. At that range the radar seeker has an accuracy of 0.17 mrad. The miss distance measurement accuracy is therefore 5 cm (300*0.17/1000=0.05 m=5 cm). The warhead is oriented to minimize the miss distance.

Typically, the warhead will rotate around a pivot passing close to its center of gravity. The rotation angle will be up to 11.5 deg as defined above. The diameter of the fragment layer will be 14 cm and the high explosive therebelow has a truncated cone shape to allow its rotation to the full required angle. This allows rotation in one plane. Rotation out of that plane is achieved by rolling the interceptor missile 110 such that the warhead is rotated within the inclined plane of the miss distance. Inasmuch as the time available for rotation is short, a powerful rotational mechanism is required. There are a number of options, of which the following are two possibilities:

1. A two way pneumatic piston that is actuated by pyrotechnically bursting a high pressure compressed nitrogen vessel. The travel of the piston is defined by a mechanical stop according to the travel angle required.

2. A two way pneumatic piston that is actuated pyrotechnically by an explosive device. The travel of the piston is defined by a mechanical stop according to the travel angle required.

As an alternative to use of an aimable warhead, microthrusters having time constants of 5 msecs may be used to quickly rotate the interceptor missile 110 to the desired angle such that the correct required attitude is reached at the fusing moment.

Preferably, the fragmentation warhead has a nominal diameter on the target of 0.65 m.

The density of the fragments is accordingly one fragment per 52 cmsq, providing an average distance of 7.2 cm between fragments. Accordingly, this results in a hit of 2 fragments on a 12 cm diameter rocket, 3 fragments on a 15 cm diameter rocket and 13 fragments on a 30 cm diameter rocket. A resulting acceptable miss distance is thus 30 cm.

Table IV indicates particulars of the fragmentation warhead 112:

| Warhead size | | |
|---|---|---|
| Frag weight | 70 | gr |
| Frag density | 19 | Tungsten or DU |
| Number of fragments | 64 | |
| Frag volume | 3.7 | cc |
| Frag cube size | 1.54 | cm |
| Frag cube area | 2.39 | cmsq |
| # of layers | 1 | |
| Frag layer area | 153 | cmsq |
| Frag eq. Dia | 14 | cm |

Table V indicate particulars of the explosive employed in the fragmentation warhead 112:

| High Eplosive | | |
|---|---|---|
| Weight | 4.5 | kg |
| Density | 1.2 | |
| Volume | 3.8 | liter |
| Dia | 15 | cm |
| Area | 153 | cmsq |
| Length | 24 | cm |

Table VI indicates parameters of impact on a target:

| Fragments on target | | |
|---|---|---|
| Footprint | 66 | cm |
| Area | 3421 | cmsq |
| Frag density | 53 | cmsq/frag |
| Frag distance | 7.3 | cm |

-continued

| Fragments on target | | |
|---|---|---|
| Diameter cm | Area cmsq | # of frag on target |
| 12 | 113 | 2 |
| 20 | 314 | 6 |
| 30 | 707 | 13 |
| 50 | 1963 | 37 |
| 80 | 5027 | 94 |
| 100 | 7854 | 148 |

It follows from the foregoing that the warhead footprint dimension on the target is directly proportional to the fusing distance. The nominal fusing distance is 3.5 m with a required accuracy of 0.5 m. At a closing velocity of about 1000 n/sec, the timing should be accurate to within 0.5 msec.

As noted above, head-on interception of a target is a particular feature of the present invention. Advantages of head-on interception include the following:

1. The miss distance is strongly decoupled from the range to the target.

2. The required terminal maneuver is relatively small for a non maneuvering target.

3. The fusing range is not critical for large target missiles 131.

4. For large target missiles 131, the fusing range can be increased to allow a bigger miss distance.

5. The deceleration of the target has no influence on the required final maneuver.

6. The target velocity is adding to the impact velocity and energy of the fragments.

7. The angular measurements at the end game require relatively small angular measurements that allow use of non gimbaled sensors 134 and 136. Such sensors are characterized by relatively low cost, high reliability and high measurement accuracy due to the strap down characteristic of the sensors.

8. Interception of maneuvering targets is relatively easy.

9. Head-on interception is practically independent of the closing velocity and allows for intercepting rockets 132 and missiles 131 at short to long tactical ranges, the limiting factor being the sensor acquisition range. As described in greater detail hereinbelow, an optical sensor 136, such as an IR optical sensor, performs better against-long range targets due to their relatively higher temperature at reentry. This attribute allows for intercepting missiles 131 or rockets 132 from ranges of 5 km to 1500 km and beyond.

In accordance with a preferred embodiment of the present invention optical sensor 136 is an uncooled microbolometer camera. A suitable microbolometer is commercially available from OPGAL, P.O. Box 462, Karmiel 20100 Israel.

Preferably, structural and operating parameters of the optical sensor are summarized hereinbelow:

The microbolometer has 384 by 288 elements having a pitch of 25 microns;

Two different focal lengths may be used, namely 45.668 mm and 91.589, providing corresponding fields of view of 12 and 6 degrees respectively in a horizontal direction;

The clear aperture is 40 mm for both focal lengths and therefore the f# for the 12 degrees system is 1.1417 while the f# for the 6 degrees system is 2.2897;

The transmittance of the objective is equal to 0.78

The interceptor missile 110 does not maneuver during target acquisition

Target acquisition is performed against a clear sky background.

A maximum output frame rate is 60 frames/sec.

For a 12 degree field of view, the highest spatial frequency (one black pixel and one white) covers an angle of 1.095 milliradians, therefore the highest resolvable spatial frequency (Nyquist frequency) is 0.913 cycles/milliradian.

For a 6 degree field of view, the highest spatial frequency (one black pixel and one white) covers an angle of 0.5459 milliradians, therefore the highest resolvable spatial frequency (Nyquist frequency) is 1.832 cycles/milliradian.

The following Tables VII, VIII and IX provide performance data for the optical sensor 136 described hereinabove:

TABLE VII

FOV 12 deg
FPA size 388 × 260 pixels
Pixel FOV 0.54 mrad

| | | S/N figures for different targets at different temperatures at different ranges | | | | | | | | | Relevant Threats | | |
|---|---|---|---|---|---|---|---|---|---|---|---|---|---|
| | Range m | 500 | 1000 | 2000 | 3000 | 4000 | 5000 | 6000 | 7000 | 8000 | Ranges | | deg K |
| D target | 12 cm | | | | | | | | | | | | |
| Ttarget | 25 deg C. | 12 | 2 | | | | | | | | | | |
| Ttarget | 50 deg C. | 20 | 3 | | | | | | | | Up to 20 km | | |
| | | | | | | | | | | | Up to 20 km | | |
| D target | 30 cm | | | | | | | | | | | | |
| Ttarget | 100 deg C. | 200 | 40 | 9 | 4 | 2 | | | | | Up to 30 km | | |
| Ttarget | 150 deg C. | 250 | 55 | 15 | 6 | 3 | | | | | Up to 40 km | | |
| | 200 deg C. | 300 | 70 | 18 | 7 | 4 | | | | | Up to 60 km | | |
| | 250 deg C. | 400 | 80 | 21 | 9 | 5 | | | | | Up to 100 km | | |
| D target | 50 cm | | | | | | | | | | | | |
| Ttarget | 200 deg C. | | 200 | 47 | 20 | 11 | 6.5 | 4.5 | 3 | 2.2 | Up to 100 km | | 473 |
| Ttarget | 250 deg C. | | 250 | 60 | 25 | 13 | 8 | 5.5 | 3.8 | 2.7 | Up to 200 km | | |
| | 400 deg C. | | 1025 | 246 | 102 | 63 | 33 | 23 | 16 | 11 | >300 km | 4.10 | 673 |
| D target | 100 cm | | | | | | | | | | | | |
| Ttarget | 200 deg C. | | 310 | 200 | 80 | 43 | 27 | 18 | 13 | 9 | | | 473 |
| Ttarget | 250 deg C. | | 380 | 250 | 100 | 55 | 33 | 21 | 16 | 11 | | k factor | |
| | 600 deg C. | | 3597 | 2321 | 928 | 499 | 313 | 209 | 151 | 104 | >500 km | 11.60 | 673 |

TABLE VIII

FOV 6 deg
FPA size 38 × 260 pixels
Pixel FOV 0.27 mrad

| | | S/N figures for different targets at different temperatures at different ranges | | | | | | | | | Relevant Threats | | |
|---|---|---|---|---|---|---|---|---|---|---|---|---|---|
| | Range m | 500 | 1000 | 2000 | 3000 | 4000 | 5000 | 6000 | 7000 | 8000 | Ranges | | deg K |
| D target | 12 cm | | | | | | | | | | | | |
| Ttarget | 25 deg C. | 6 | 1.5 | | | | | | | | | | |
| Ttarget | 50 deg C. | 10 | 2 | | | | | | | | Up to 20 km | | |
| | | | | | | | | | | | Up to 20 km | | |
| D target | 30 cm | | | | | | | | | | | | |
| Ttarget | 100 deg C. | | 30 | 8 | 2.5 | | | | | | Up to 30 km | | |
| Ttarget | 150 deg C. | | 40 | 8 | 4 | | | | | | Up to 40 km | | |
| | 200 deg C. | | 50 | 10 | 4.5 | 2.5 | | | | | Up to 60 km | | |
| | 250 deg C. | | 60 | 15 | 5.5 | 3 | | | | | Up to 100 km | | |
| D target | 50 cm | | | | | | | | | | | | |
| Ttarget | 200 deg C. | | | 30 | 13 | 7 | 4 | 2.8 | | | Up to 100 km | | 473 |
| Ttarget | 250 deg C. | | | 37 | 16 | 8 | 5 | 3.5 | | | Up to 200 km | | |
| | 400 deg C. | | | 152 | 88 | 33 | 20 | 14 | | | >300 km | 4.1 k factor due to higher Temp | 673 |
| D target | 100 cm | | | | | | | | | | | | |
| Ttarget | 200 deg C. | | | | 45 | 28 | 18 | 11 | 7.5 | 3.2 | | | 473 |
| Ttarget | 250 deg C. | | | | 55 | 33 | 20 | 14 | 9.5 | 4 | | | |
| | 600 deg C. | | | | 522 | 325 | 209 | 128 | 87 | 37 | >500 km | 11.6 | 873 |

TABLE IX

FOV = 12 degrees
Summary table for acquisition ranges and closing velocities. Accuracy 0.54 mrad.

| | | | Acquisition range m | S/N | Vtarget m/sec | Vinterceptor m/sec | Vrelative m/sec | Ttoimpact sec |
|---|---|---|---|---|---|---|---|---|
| Rockets up to 20 km | | | | | | | | |
| D target | 12 cm | | 500 | 12 or 20 | 200 | 600 | 800 | 0.63 |
| Ttarget | 25 deg C. | 12 | | | | | | |
| Ttarget | 50 deg C. | 20 | | | | | | |
| Rockets up to 40 km | | | | | | | | |
| D target | 30 cm | | | | | | | |
| Ttarget | 100 deg C. | 9 | 2000 | 9 or 15 | 450 | 600 | 1050 | 1.90 |
| Ttarget | 150 deg C. | 15 | | | | | | |
| Rockets up to 70 km | | | | | | | | |
| D target | 30 cm | | | | | | | |
| Ttarget | 200 deg C. | 7 | 3000 | 7 or 9 | 600 | 600 | 1200 | 2.50 |
| Ttarget | 250 deg C. | 9 | | | | | | |
| Rockets up to 200 km | | | | | | | | |
| D target | 50 cm | | | | | | | |
| Ttarget | 200 deg C. | 11 | 4000 | 11 or 13 | 800 | 600 | 1400 | 2.86 |
| Ttarget | 250 deg C. | 13 | | | | | | |
| Missiles up to 300 km | | | | | | | | |
| D target | 50 cm | 11 | 8000 | 11 | 1200 | 600 | 1800 | 4.44 |
| Ttarget | 400 deg C. | | | | | | | |
| Missiles up to 1500 km | | | | | | | | |
| D target | 100 cm | 50(*) | 16000 | 50 | 2000 | 600 | 2600 | 6.15 |
| Ttarget | 600 deg C. | | | | | | | |

(*)S/N at double the range is reduced to 20%
By switching the FOV from 12 deg to 6 deg at half the acquisition range we double the resolution and triple S/N
Example:
at 12 deg FOV the S/N of 50 cm/250 deg C. at 6000 m is 5.5
At 6 deg FOV the S/N of 50 cm/250 deg C. at 3000 m is 16

The following performance characteristics may be achieved based on the foregoing tables:

For Tracking with FOV=12 deg, Accuracy=0.54 mrad 12 cm diameter rockets at >25 degC can be detected and tracked from 500 m to interception. Optical tracking time is 0.63 sec.

30 cm diameter rockets at >100 degC can be detected and tracked from 2000 m to impact. Optical tracking time is 1.9 sec.

30 cm diameter rockets at >200 degC can be detected and tracked from 3000 m to impact. Optical tracking time is 2.5 sec.

50 cm diameter rockets at >200 degC can be detected and tracked from 4000 m to impact. Optical tracking time is 2.9 sec.

50 cm diameter rockets at >400 degC can be detected and tracked from 8000 m to impact. Optical tracking time is 4.4 sec.

100 cm diameter rockets at >600 degC can be detected and tracked from 16000 m to impact. Optical tracking time is 6.15 sec.

For Tracking with FOV=6 deg, Accuracy=0.27 mrad 30 cm diameter rockets at >100 degC can be detected and tracked from 1000 m to impact.

30 cm diameter rockets at >200 degC can be detected and tracked from 1500 m to impact.

50 cm diameter rockets at >200 degC can be detected and tracked from 2000 m to impact.

50 cm diameter rockets at >400 degC can be detected and tracked from 4000 m to impact.

100 cm diameter rockets at >600 degC can be detected and tracked from 8000 m to impact.

Principal structural and operational characteristics of the interceptor missile 110 are described hereinbelow:

The interceptor missile 110 will operate up to altitudes of 20 km, at a quasi constant velocity of about 600 m/sec. Preferably interceptor missile 110 will have a relatively short boost period that will accelerate it to the required velocity, followed by a relatively long sustain period to compensate for drag and for g losses in gaining altitude.

Preferably, a 1200 kg 5 sec boost and a 150 kg sustain for a period of 30 sec are employed. The interceptor missile 110 preferably has a maneuvering capability of up to 60 "g"s.

TABLE X sets forth the weight breakdown of a preferred embodiment of the interceptor missile 110:

TABLE X

| Weight breakdown | |
|---|---|
| Warhead weight | 9 kg |
| Avionics weight | 10 kg |
| Structure | 10 kg |

TABLE X-continued

| Weight breakdown | |
|---|---|
| Control weight | 5 kg |
| RM inert weight | 13.7 kg |
| Total inert | 47.75 kg |
| Mpbooster | 26.0 kg |
| Mpsustain | 19.8 kg |
| Total loaded | 93.6 kg |

TABLES XI and XII set forth the rocket motor characteristics of a preferred embodiment of the interceptor missile 110:

TABLE XI

| Rocket motor-Booster | |
|---|---|
| Thrust | 1200.0 kg |
| Tb | 5 sec |
| Isp | 230.6 |
| m dot | 5.20 kg/sec |
| Mpboost | 26.0 kg |
| Mpsustain | 19.8 |
| Mptotal | 45.8 |
| Minert (0.3 Mp) | 13.7 kg |

TABLE XII

| Rocket motor-Sustainer | |
|---|---|
| Thrust sustain | 150 kg |
| Isp sustain | 227.3 sec |
| Mdot sustainer | 0.66 kg/sec |
| kg sustainer | 19.8 kg/sec |
| Tb sustain | 30 sec |

Interceptor missile 110 can be launched along constant slope trajectories at any angle from zero to 90 deg. Tables XIII, XIV and XV below provide parameters for a launch at 30 degrees:

TABLE XIII

| Boost phase | |
|---|---|
| M initial | 93.6 kg |
| M final | 47.75 kg |
| Jx initial | 125.8 m/sec^2 |
| Jx final | 174.3 m/sec^2 |
| Jx average | 150.0 m/sec^2 |
| Tb = | 5 sec |
| Vend | 641.3 m/sec |
| R at end of burn | 1600 m |

TABLE XIV

| Coast phase | |
|---|---|
| M initial | 67.5 kg |
| M final | 47.75 kg |
| Jx initial | 21.8 m/sec^2 |
| Jx final | 30.8 m/sec^2 |
| Jx average | 26.3 m/sec^2 |
| Tb = | 30 sec |
| Vini | 641.3 m/sec |
| Vend | 656.4 m/sec |
| R at end of burn | 19592 m |

TABLE XIV-continued

| Coast phase | |
|---|---|
| X at end of burn | 16968 m |
| Z at end of burn | 9795 m |

For T = 35 sec (end of propelled coast)

TABLE XV

| Coast phase 10 sec after end of propuls | |
|---|---|
| Vini | 656.4 m/sec |
| Vend | 489.3 m/sec |
| R at end of burn | 25263 m |
| X at end of burn | 21879 m |
| Z at end of burn | 12630 m |

For T = 45 sec

In order to attain a long interception range, it is necessary to provide the highest possible velocity at low altitude for as long a time as required. In order to limit the aerodynamic heating to manageable figures (Total temperature between 200 and 300 degC), the speed of the interceptor missile 110 must stay within the range of Mach=2.0 to Mach=2.5 (About 650 m/sec). To reach this velocity a boost of about 15 g for 5 seconds is required. In order to achieve an interception range of about 20 km, this velocity must be sustained for about 30 seconds, by having a propelled coast.

In order to increase the interception range (footprint), the propelled coast must increase by approximately 10 seconds for each 6 km of additional interception range.

High maneuverability of interceptor missile 110 is achieved by two factors: High missile velocity at low altitudes (from sea level to 10 km) and a high lift configuration.

The configuration illustrated in FIG. 1 achieves a Lift Coefficient=0.5 at 6 deg angle of attack and will produce a lift of 2700 kg at a dynamic pressure of 2 atm. This will produce a maneuver of 49 "g" at 35 seconds (end of powered sustain phase at sea level).

The steps of the interception are the following:

1. Detection by the Early Warning System (EWS) 100 that a missile 131 or rocket 132 was fired.

2. Tracking of the incoming missile 131 or rocket 132 by the EWS 100 and confirmation that the thereat impact point is threatening an area to be protected.

3. Choosing by the Battle Management System (BMS) 102 of a battery 104 to fire an interceptor missile 110 and provision by the BMS 102 to the battery 104 of the relevant data of the incoming missile 131 or rocket 132 (coordinates, velocity, predicted trajectory etc.)

4. The battery 104 selects an interceptor missile 110, loads into it the Initial Mission Parameters (IMS) and fires it. The IMS includes a first estimation of the trajectory parameters of the incoming missile 131 or rocket 132.

5. Based on the IMS, the interceptor missile 110 calculates a Turning Point (TP) and guides itself to this point. The TP is defined such that the interceptor missile 110 maneuvers and positions itself in a head-on orientation with respect to the incoming missile 131 or rocket 132 target that will provide a 2 seconds time for end game to interception. The distance to the target will vary according to the closing velocity between target and interceptor missile 110.

6. During its flight, the interceptor missile 110 receives via a data uplink updates at 10 HZ as to any revised TP and revised trajectory parameters of the incoming missile 131 or rocket 132.

7. Once the interceptor missile 110 is aligned with the target, the interceptor missile 110 goes into acquisition mode, employing either or both of sensors 134 and 136. This operation results to a hand over from the ground-based radar 122 to on-board sensors 134 and 136. The ground-based radar 122 continues updating the interceptor missile 110 via the uplink as to the relative position and relative velocity between the target and the interceptor missile 110.

8. As the distance between the target and interceptor missile 110 diminishes, the angular position accuracy of the sensors 134 and 136 increases and achieves a miss distance of less than 30 cm.

9. The on board radar 134 measures continuously the range and the relative velocity to the target. This data is used also to calibrate biases in information received from the ground-based radar 122 and to process warhead fusing information.

10. When the fusing range is achieved, a fusing signal is issued to detonate the warhead and destroy the target.

It is appreciated that the nature of ballistic missiles or rockets is that they are designed for minimum drag and their lift is produced by the cone only, therefore their maneuverability is limited. For an incoming rocket 132 having a diameter of 30 cm, a weight of 350 kg and reentering at a velocity of 600 m/sec, the maximum lift will be 700 kg, providing a reentry maneuvering capability of 2 "g"s (Q=2 atm, Cl=0.5, S=700 cmsq). The interceptor missile 110 preferably has a maneuvering capability of 57 g at same Q condition. There is therefore a factor of 10 to 30 between the maneuvering capability of the target and the interceptor missile 110, which enables interception by interceptor missile 110 as described hereinabove.

As noted hereinabove, major stages of the interception are the following:

1. Launch
2. Fly towards the turning point
3. Reach the turning point and turn to head-on position
4. End game and interception The interception range defines the defended footprint. The start altitude of interception reached at stage 3 above is achieved by flying a constant slope trajectory. This is not the optimal trajectory energetically but is the best trajectory system wise, because its geometry is deterministic and straightforward to calculate and modify.

Table XVI sets forth the interception ground range for various end game start altitudes at the end of propelled coast phase. It is appreciated that up to an altitude of 8 km, the interception range at interception altitude is about 18 km. These ranges are achieved by flying trajectory slopes between 1 deg to 25 degrees. At trajectory slopes higher than 25 degrees, the interception altitudes range from 8 km to 17 km, and the interception ground ranges are 7 km to 10 km. The protected footprint is the projection of the target trajectory on the ground, which depends on the slope of the target trajectory. For a vertical trajectory, the two are identical. It is noted that at an interception altitude of 15 km there is a residual maneuvering capability of 15 g.

TABLE XVI

| Gamma deg | Range X | Altitude Z | Maneuvering "g"max |
|---|---|---|---|
| 1 | 17.8 | 0.3 | 53 |
| 5 | 18.1 | 1.6 | 49 |
| 10 | 18.3 | 3.2 | 44 |
| 15 | 18.2 | 4.9 | 39 |
| 20 | 18.0 | 6.6 | 34 |
| 25 | 17.6 | 8.2 | 30 |

TABLE XVI-continued

| Gamma deg | Range X | Altitude Z | Maneuvering "g"max |
|---|---|---|---|
| 30 | 17.0 | 9.8 | 26 |
| 35 | 16.2 | 11.3 | 22 |
| 40 | 15.2 | 12.8 | 20 |
| 45 | 14.1 | 14.1 | 17 |
| 50 | 12.8 | 15.3 | 15 |
| 55 | 11.5 | 16.4 | 14 |
| 60 | 10.0 | 17.3 | 12 |

The maximum interception altitude is about 15 km at a ground range of 13 km. The interception capability for a single interceptor missile 110 is half of a sphere having a ground range of 18 km up to an altitude of 8 km.

By extending the propelled coast stage to 60 sec, the interception ranges shown in Table XVII may be realized.

TABLE XVII

| Gamma deg | Range X | Altitude Z | Maneuvering "g"max |
|---|---|---|---|
| 1 | 35.6 | 0.6 | 40.1 |
| 5 | 37.6 | 3.3 | 35.2 |
| 10 | 39.7 | 7.0 | 27.7 |
| 15 | 41.1 | 11.0 | 20.1 |
| 20 | 41.7 | 15.2 | 13.7 |
| 25 | 41.5 | 19.3 | 9.0 |

It is appreciated that by extending the powered coast to 60 seconds, the interception range is more than doubled. The penalty is an increase in weight of interceptor missile 110 from 94 kg to 144 kg.

In such a case, the interception radius increases from 18 km to 36 km for altitudes up to 3 km and to 40 km at higher altitudes. The width of the protected area increases from 40 to 80 km against missiles fired from ranges beyond 60 km.

The following glossary is provided to assist in understanding terms that appear hereinabove, particularly in the tables:

Glossary

ATAN Arc Tangent
Atm atmospheres
Tam Temperature Ambient
BMS Battle Management System
cc Centimeter cube
cm Centimeter
Cl Lift coefficient
Cmsq square centimeter
Cod Drag coefficient
D, Diam Diameter
DU Depleted Uranium
Deg Degree
DegC Degree Celsius
DegK Degree Kelvin
EWS Early Warning System
FOV Field of View
Frag Fragments
FPA Focal Plan Array
G Earth acceleration
Gr gram
HEX High Explosive
Hz Hertz
Isp Specific Impulse
IMS Initial Mission Parameter
IR Infra Red InSb Indium Antimonide
Jx Horizontal Acceleration
K factor correction factor due to temperature
kg Kilogram
km Kilometer
m Meter
mm Millimeter
M Mass
MCT Mercury Cadmium Telluride
MRTD Multi Resolution Time Domain
Mrad Milliradian
max Maximum
m/sec, m/s Meter per second
mdot Mass flow
m/s^2 meter per second per second
msq square meter
Mp Mass of propellant
n number of g
NETD Noise Equivalent Temperature Degree
Q Dynamic pressure
RS Radar Seeker
RM Rocket Motor
S Surface
S/N Signal to Noise
SNR Signal to Noise Ratio
Sec Second
T Time
Tb Burn Time
Temp Temperature
tot total
TP Turning Point
V Velocity
Vend End velocity
Vini Initial Velocity
X Interception ground range
Z Altitude It will be appreciated by persons skilled in the art that the present invention is not limited by what has been particularly shown and described hereinabove. Rather the scope of the present invention includes both combinations and subcombinations of the various features described hereinabove as well as modifications and variations thereof which would occur to persons skilled in the art upon reading the foregoing description and which are not in the prior art.

The invention claimed is:

1. An interception system for intercepting incoming missiles and/or rockets comprising:

a launch facility;

a missile configured to be launched by said launch facility, said missile having a fragmentation warhead;

a ground-based missile guidance system for guiding said missile during at least one early stage of missile flight; and a missile-based guidance system for guiding said missile during at least one later stage of missile flight, said missile-based guidance system being operative to direct said missile in a last stage of missile flight in a head-on direction vis-à-vis an incoming missile or rocket.

2. An interception system according to claim 1 and wherein said missile-based guidance system comprises a strap-on, non-gimbaled short range radar sensor and a strap-on, non-gimbaled optical sensor.

3. An interception system according to claim 2 and wherein said short range radar sensor senses the relative positions and speeds of said missile and said incoming missile or rocket.

4. An interception system according to claim 3 and wherein said short range radar sensor provides a detonation trigger output to said fragmentation warhead based on said relative positions and relative speeds of the missile and said incoming missile or rocket.

5. An interception system according to claim 4 and wherein said short range radar sensor also provides a guidance output for governing the direction of said missile during said at least one later stage of missile flight.

6. An interception system according to claim 2 and wherein said short range radar sensor provides sensing back up for said optical sensor, when said optical sensor is not fully functional.

7. An interception system according to claim 1 and also comprising an early warning system operative to provide information relating to said incoming missile or rocket to said launch facility.

8. A method for intercepting incoming missiles and/or rockets comprising:

launching at least one missile, said at least one missile having a fragmentation warhead;

guiding said at least one missile, using a ground-based missile guidance system, during at least one early stage of missile flight;

guiding said at least one missile, using a missile-based guidance system, during at least one later stage of missile flight; and directing said missile, using said missile-based guidance system, in a last stage of missile flight in a head-on direction vis-à-vis an incoming missile or rocket.

9. A method according to claim 8 and also comprising sensing the relative positions and relative speeds of said missile and said incoming missile or rocket.

10. A method according to claim 9 and also comprising providing a detonation trigger output to said fragmentation warhead based on said sensing the relative positions and relative speeds.

11. A method according to claim 10 and also comprising providing information relating to said incoming missile or rocket to said at least one missile.

12. A method according to claim 9 and also comprising providing information relating to said incoming missile or rocket to said at least one missile.

13. A method according to claim 8 and also comprising providing information relating to said incoming missile or rocket to said at least one missile.

* * * * *